US007336194B2

(12) United States Patent
Hillman et al.

(10) Patent No.: US 7,336,194 B2
(45) Date of Patent: Feb. 26, 2008

(54) CLOSURE FOR BOTTLE/CONTAINER

(75) Inventors: Mark Philip Scowne Hillman, Poole Dorset (GB); Peter England, Dorset (GB)

(73) Assignee: APWH Limited, Poole, Dorset (GB)

( * ) Notice: Subject to any disclaimer, the term of this patent is extended or adjusted under 35 U.S.C. 154(b) by 297 days.

(21) Appl. No.: 11/132,555

(22) Filed: May 19, 2005

(65) Prior Publication Data

US 2006/0261972 A1 Nov. 23, 2006

(51) Int. Cl.

| | |
|---|---|
| ***A61J 1/03*** | (2006.01) |
| ***B65D 55/002*** | (2006.01) |
| ***G08B 13/08*** | (2006.01) |
| ***G08B 21/00*** | (2006.01) |

(52) U.S. Cl. ..... 340/686.1; 340/545.6; 215/204

(58) Field of Classification Search ..... 340/686.1, 340/686.2, 545.6, 502, 541, 542; 215/201–225
See application file for complete search history.

(56) References Cited

U.S. PATENT DOCUMENTS

| | | | | |
|---|---|---|---|---|
| 6,082,565 | A * | 7/2000 | Harrold | 215/218 |
| 6,239,712 | B1 | 5/2001 | Hawk | |
| 6,545,594 | B1 * | 4/2003 | Knight et al. | 340/384.7 |
| 6,771,165 | B2 * | 8/2004 | Burg II et al. | 340/384.1 |
| 2002/0000908 | A1 | 1/2002 | Burg, II et al. | |
| 2003/0189494 | A1 * | 10/2003 | Lin | 340/686.1 |
| 2004/0116036 | A1 | 6/2004 | Nugent et al. | |
| 2005/0110647 | A1 * | 5/2005 | Ritson | 340/686.1 |

FOREIGN PATENT DOCUMENTS

| | | |
|---|---|---|
| DE | 94 08 873.1 | 10/1994 |
| EP | 0 490 775 A1 | 6/1992 |
| EP | 0 609 171 A1 | 8/1994 |
| GB | 2 344 101 A | 5/2000 |

* cited by examiner

*Primary Examiner*—Benjamin C. Lee
*Assistant Examiner*—Jennifer Mehmood
(74) *Attorney, Agent, or Firm*—Brinks Hofer Gilson & Lione

(57) ABSTRACT

A closure for a container comprises means to secure the closure to the mouth of the container and an electronic device. The closure further comprises activation means operative to activate the electronic device when the closure is rotated relative to the container. The closure comprises a lower closure half comprising means to secure the closure to the container, and an upper closure half rotatably mounted on the lower closure half. A container comprising such a closure is also provided. The electronic device could comprise a sound-emitting device, a vibratory device or a light-emitting device.

31 Claims, 3 Drawing Sheets

CLOSURE FOR BOTTLE/CONTAINER

FIELD OF THE INVENTION

The present invention relates to a closure and particularly but not exclusively relates to a twist on closure for use with bottles or containers.

BACKGROUND OF THE INVENTION

It has previously been proposed to provide closures containing electronic devices.

However such closures have typically been relatively large and unwieldy to use.

SUMMARY OF THE INVENTION

According to one aspect of the invention there is provided a closure for a container, the closure comprising means to secure the closure to the mouth of the container, an electronic device, and activation means operative to activate the electronic device when the closure is rotated relative to the container.

Preferably the closure comprises a lower closure half comprising means to secure the closure to the container, and an upper closure half rotatably mounted on the lower closure half.

Preferably the upper closure half comprises a cavity for storing the electronic device.

Preferably the activation means comprises an electronic contact on the lower closure half and another electronic contact on the upper closure half, relative rotation between the closure halves bringing the electronic contacts together to complete an electronic circuit.

Preferably one of the electronic contacts comprises a planar contact pad, the other contact comprising a pin which slides over the pad during relative rotation between the closure halves.

Preferably rotation limiting means are provided to limit the amount by which one closure half can rotate relative to the other closure half.

Preferably the rotation limiting means comprises at least one formation on one closure half which, during relative rotation between the closure halves, engages with at least one formation provided on the other closure half.

Preferably the rotation limiting means comprises a plurality of formations on each closure half.

Preferably each formation comprises a lug.

Preferably the lug on the lower closure half is upstanding from the top of the lower closure half.

Preferably the lug on the upper closure half is radially inwardly directed.

Preferably the upper closure half is removably mounted on the lower closure half.

Most preferably one of the closure halves comprises securing means that secures the closure halves together. Preferably the securing means comprises a peripheral radially projecting rib on one closure half that engages a corresponding peripheral radially projecting rib on the other closure half.

Preferably the closure comprises a bottle top for screwing onto a bottle.

Preferably the upper closure half is operative to rotate relative to the lower closure half to activate the electronic device.

Preferably the upper closure half is operative to rotate relative to the lower closure half in the same rotational direction as is required to twist the closure from the container.

Preferably the electronic device comprises a sound-emitting device.

Preferably the sound-emitting device comprises a PCB and a speaker operative to emit a pre-recorded message when the electronic device is activated.

Preferably the closure comprises child resistant means. Preferably the child resistant means is operative such that the upper closure half has to be pushed down onto the lower closure half to enable rotation of both closure halves to remove the closure from the container.

According to another aspect of the invention there is provided a container comprising a closure provided with means to secure the closure to the mouth of the container, an electronic device, and activation means operative to activate the electronic device when the closure is rotated relative to the container.

According to a further aspect of the invention there is provided a closure for a container, the closure comprising means to secure the closure to the mouth of the container, an electronic device, and activation means operative to activate the electronic device when the closure is pressed down onto the container.

Preferably the closure comprises a lower closure half comprising means to secure the closure to the container, and an upper closure half rotatably mounted on the lower closure half.

Preferably the upper closure half comprises a cavity for storing the electronic device.

Preferably the activation means comprises a switch on one of the closure halves, downward movement of the upper closure half onto the lower closure half moving the switch into a position where the switch completes an electronic circuit which activates an electronic device.

Preferably the upper and lower closure halves are formed with respective formations operative to lock the two closure halves together when the upper closure half is pressed down onto the lower closure half so that rotation of the upper closure half causes rotation of the lower closure half.

Preferably the formations comprise castellations.

Preferably ratchet means is provided operative to permit rotation of one closure half relative to the other closure half in one rotational direction only.

Preferably the upper closure half is removably mounted on the lower closure half.

Most preferably one of the closure halves comprises securing means that secures the closure halves together. Preferably the securing means comprises a peripheral radially projecting rib on one closure half that engages a corresponding peripheral radially projecting rib on the other closure half.

Preferably the closure comprises a bottle top for screwing onto a bottle.

Preferably the electronic device comprises a sound-emitting device.

Preferably the sound-emitting device comprises a PCB and a speaker operative to emit a pre-recorded message when the electronic device is activated.

Preferably the closure comprises child resistant means. Preferably the child resistant means is operative such that the upper closure half has to be pushed down onto the lower closure half to enable rotation of both closure halves to remove the closure from the container.

According to another aspect of the invention there is provided a container comprising a closure provided with means to secure the closure to the mouth of the container, an electronic device, and activation means operative to activate the electronic device when the closure is pressed down onto the container.

Other aspects of the present invention may include any combination of the features or limitations referred to herein.

BRIEF DESCRIPTION OF THE DRAWINGS

The present invention may be carried into practice in various ways, but embodiments will now be described by way of example only with reference to the accompanying drawings in which.

DETAILED DESCRIPTION OF THE INVENTION

Figure 1:
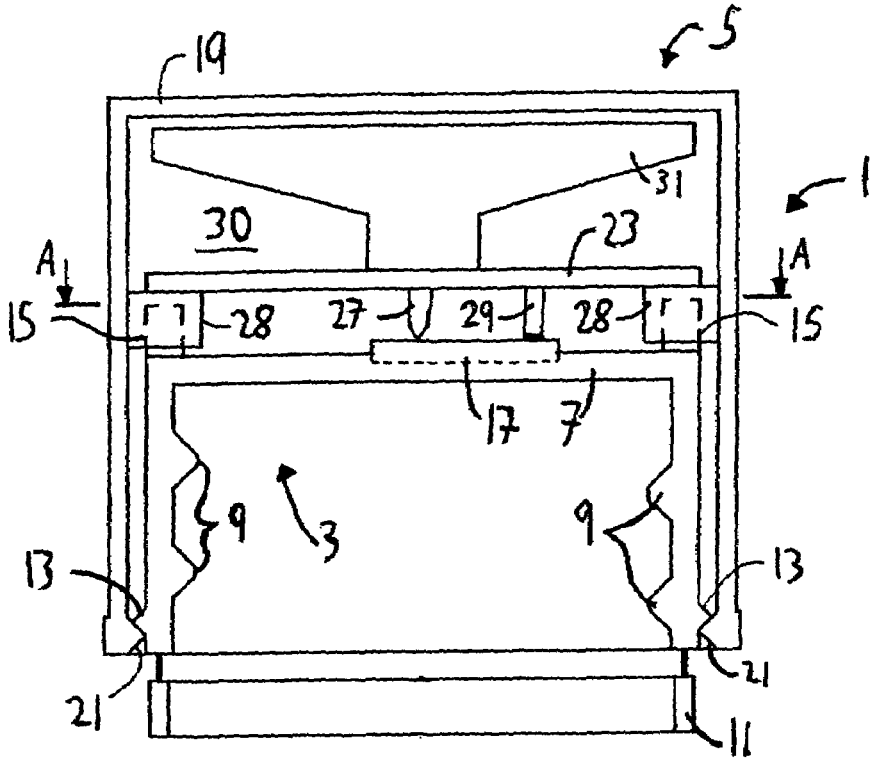
FIG. 1 is a sectional side view of a closure in accordance with the present invention.
Figure 2:
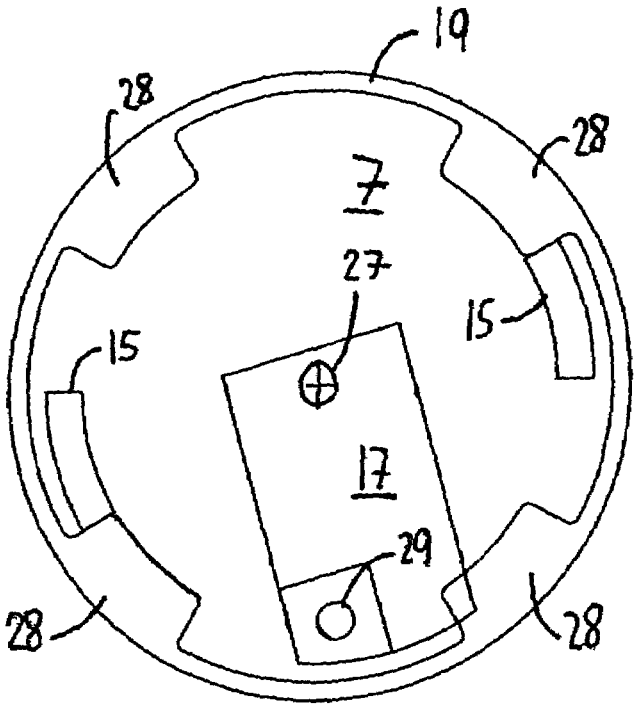
FIG. 2 is a sectional plan view taken on line A-A of FIG. 1.
Figure 3:
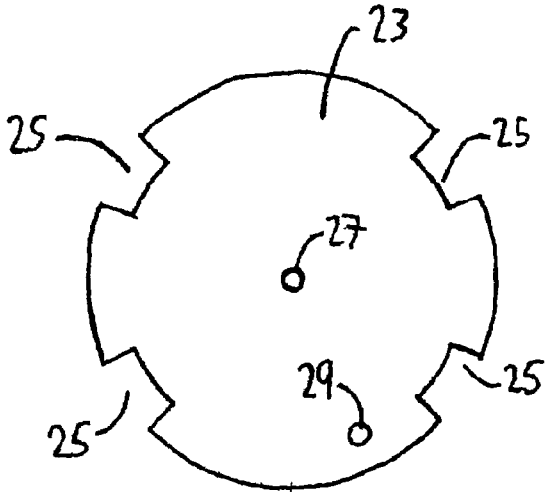
FIG. 3 is a plan view of part of the closure of FIGS. 1 and 2.
Figure 4:
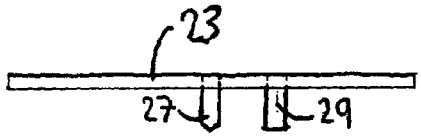
FIG. 4 is a side view of the part of the closure of FIG. 3.

Referring to FIGS. 1 to 4, a twist on closure 1 for, for example, a bottle (not shown) comprises a lower closure half 3 and an upper closure half 5.

The lower closure half 3 comprises a hollow cylinder 7 the lower end of which is open to receive the neck of the bottle. The inside of the cylinder 7 is threaded 9 to engage with corresponding threads on the outside of the bottle. The lower end of the cylinder 7 is secured to a tamper resistant ring 11 as is well known.

Securing means is provided comprising a radially outwardly projecting circumferential rib 13 positioned adjacent the lower end of the cylinder 7.

Two diametrically opposed, arcuate lugs 15 are upstanding from the top surface of the lower closure half 3. These lugs 15 comprise part of rotation limiting means operative to limit the magnitude of relative rotation between the upper and lower closure halves 3, 5.

A planar rectangular electrical contact pad 17 is mounted on the top surface of the lower closure half 3 and extends generally from the axis of the lower closure half 3 to the periphery of the lower closure half 3. The width of the contact pad 17 is approximately half the length of the contact pad 17.

The upper closure half 5 comprises a hollow cylinder 19 the lower end of which is open to receive the lower closure half 3.

Securing means is provided on the upper closure half 5 comprising a radially inwardly projecting circumferential rib 21 positioned adjacent the lower end of the cylinder 19 which engages the rib 13 of the lower closure half 3 to secure the closure halves 3, 5 together.

An electronic device is provided comprising a PCB 23 of generally disc like form comprising four equi-spaced arcuate cut outs 25. The PCB 23 is provided with a first electrical contact pin 27 at the axis of the PCB 23 and which rests, when the upper closure half 5 is mounted on the lower closure half 3, on part of the contact pad 17. The PCB 23 is mounted in the upper closure half 5 with the cut outs 25 being positioned between respective radially inwardly directed lugs 28 provided on the inner wall of the upper closure half 5.

The PCB 23 further comprises a second contact pin 29 radially spaced from the PCB central axis.

The pins 27, 29 comprise opposite ends of the PCB circuit. The PCB 23, in this example, is a sound emitting electronic device and is connected to a speaker 31 mounted in an upper cavity 30 of the upper closure half 5. The PCB 23 comprises storage means on which is stored a pre-programmed sound stream, which may be for example a voice message, which activates when the PCB circuit is completed.

The upper closure half 5 and PCB 23 are mounted on the lower closure half 3 by pressing the two halves 3, 5 together such that the rib 21 of the upper closure half 5 clips over the rib 13 of the lower closure half 3, the ribs 13, 21 then inter-engaging to retain the closure halves 3, 5 together.

When so mounted, the lower surface of the PCB 23 rests on the tops of the radially inwardly directed lugs 28 of the upper closure half 5, the lugs 28 being positioned between the upstanding lugs 15 of the lower closure half 3

The radially inner electrical pin 27 rests on, and is in electrical contact with, the electrical contact pad 17. The initial relative rotational position of the lower and upper closure halves 3, 5 is such that the radially outer contact pin 29 does not initially rest on the pad 17.

When the user opens the bottle by twisting the closure 1 relative to the bottle, the upper closure half 5 initially rotates relative to the lower closure half 3 so that each upstanding lug 15 on the lower closure half 3 moves from being adjacent one respective radially inwardly directed lug 28 of the upper closure half 5 to being adjacent the next respective lug 28 of the upper closure half 5. This magnitude of rotation is sufficient to move the radially outer contact pin 29 into sliding and electrical contact with the contact pad 17 which completes the PCB circuit. This activates the pre-stored sound or voice message which plays as the user further rotates the closure 1 to unscrew the closure 1 from the bottle.

It will be appreciated that the closure 1 could be a closure for any suitable kind of container including, for example, a drinks bottle, cosmetics bottle, pharmaceutical bottle, or a food bottle or container.

The pre-stored sound could comprise any desired sound or sound stream including a novelty sound stream relating to, for example, a promotion, or an information notice which might be useful to let partially sighted people know what is in the container that they are opening.

During assembly, the lower closure half 3 can be assembled onto the container without the upper closure half 5 so that the bottle and lower closure half 3 can be sterilised. Once sterilised the upper closure half 5 and PCB 23 can be clipped onto the lower closure half 3 so as to prevent the sterilisation process damaging the PCB 23. The PCB 23 is inserted upwardly into the cavity 30 from the open lower end of the upper closure half 5.

The closure 1 could be made from any suitable material or combination of materials including for example, a plastics material or materials.

The closure 1 could be secured to the container using any suitable twist mechanism which may be the screw threads 9 described or could comprise any other means whereby the closure is rotated onto and off the container.

The electronic device could comprise any suitable desired electronic device including, for example a sound-emitting device, a vibratory device, or a light-emitting device. The vibratory device or light-emitting device could be positioned in cavity 30 instead of the speaker 31.

The stored sound or sound stream can be stored during manufacture, or can be updated post manufacture by, for example, downloading a new sound stream into the PCB 23.

Figure 5:
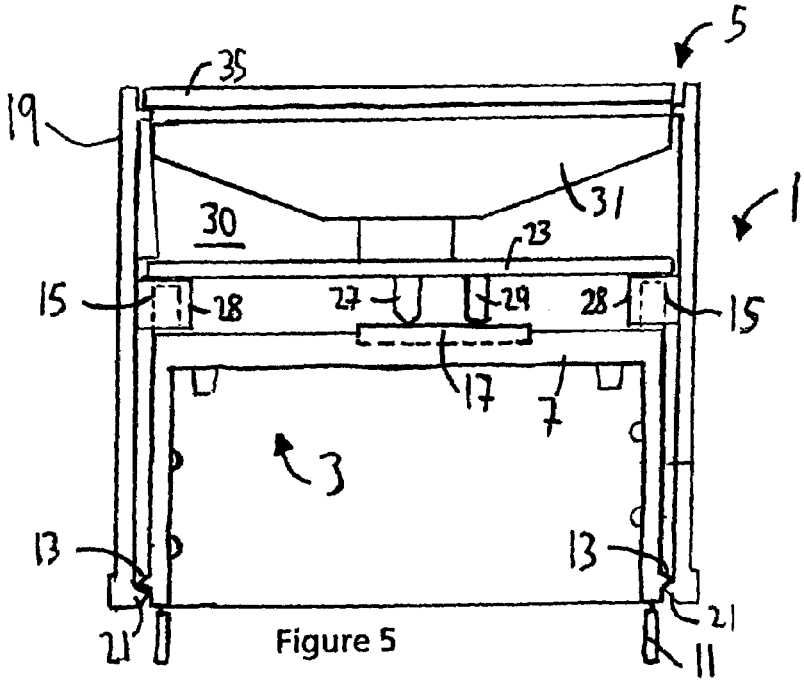
FIG. 5 is a sectional side view of a modified closure in accordance with the present invention.

Referring to FIG. 5, a modified closure 1 comprises a removable top cap 35 that clips onto the top of the upper closure half 5 to seal the cavity 30. This enables the PCB 23 to be inserted into the cavity 30 in a downward direction from the top of the upper closure half 5.

Figure 6:
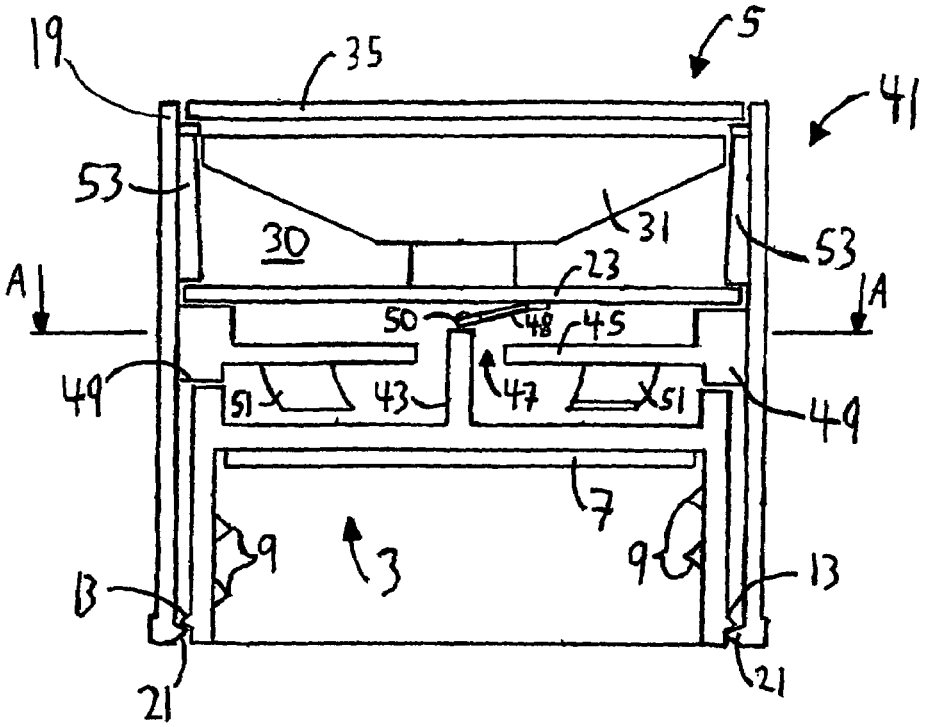
FIG. 6 is a sectional side view of a closure in accordance with another aspect of the present invention.
Figure 7:
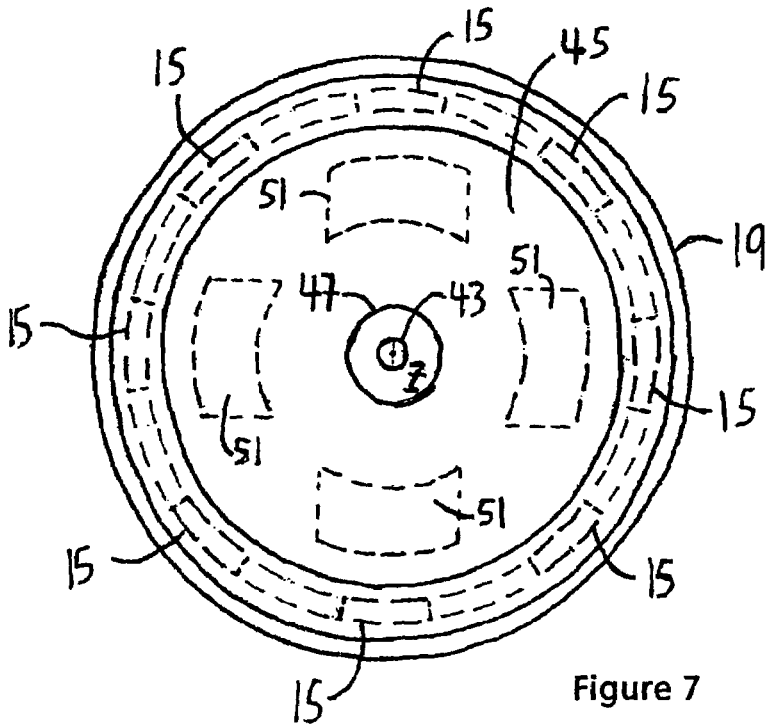
FIG. 7 is a sectional plan view taken on line A-A of FIG. 6.

Referring now to FIGS. 6 and 7 a modified closure 41 comprises lower and upper closure halves 3, 5 with like features being given like references.

The upper surface of the lower closure half 3 is provided with an upstanding axially aligned pushpin 43. Eight, equispaced upstanding lugs 15 are provided such that the top of the lower closure half 3 is castellated.

The upper closure half 5 comprises a centrally mounted disc 45 above which is defined the storage cavity 30. The disc 45 is formed with an axially aligned circular aperture 47 through which the push pin 43 extends. The lower surface of the disc 45 is castellated 49 at the outer periphery of the disc 45. Deflectable ratchet members 51 extend downwardly from the under side of the disc 45, and comprise part of the child resistant means as is well known.

The PCB 23 rests on top of the disc 45 with the speaker on top of the PCB 23. Lugs 53 project radially inwardly from the inner wall of the cavity 30 and engage with the cut outs 25 formed in the periphery of the PCB 23 to locate the PCB 23 in position within the cavity 30.

The PCB 23 is connected to one end of a switching arm 48. The distal end 50 of the arm 48 can be moved into switching contact with the PCB 23.

When in the position shown in FIG. 6, the castellations on the lower and upper closure halves 3, 5 are not engaged. The ratchet members 51 are inclined to the vertical and engage with formations (not shown) provided on the upper surface of the lower closure half 3 such that the upper closure half 5 can be rotated in one direction (because the ratchet members deflect and slide over the formations) but not in the other direction (because the ratchets do not deflect and instead dig into the formations).

When a user wishes to remove the closure 41 from the container. The user first pushes the upper closure half 5 down onto the lower closure half 3 so that the castellations on the disc 45 of the upper closure half 5 engage the castellated lugs 15 of the lower closure half 3. This enables rotation of the upper closure half 5 to cause rotation of the lower closure half 3 which in turn enables the closure 41 to be unscrewed from the container.

This pushing down motion simultaneously brings the top of the push pin 43 into engagement with the underside of the distal end 50 of the switching arm 48, moving the switching arm 48 into contact with the underside of the PCB 23, closing the PCB circuit and activating the electronic device.

The closure 41 may alternatively comprise a twist activated electronic device as described above with reference to FIGS. 1 to 5. The push pin 43 and switching arm 48 would be replaced by the radially spaced contact pins 27, 29 and the rectangular contact pad 17 which would be secured to the upper surface of disc 45. The pin 29 would slide onto and over the pad 17 when an inner casing (not shown) located in upper closure half 5 above disc 45 is rotated relative to the upper closure half 5.

The activation means could be arranged to be activated with or without pushing the upper closure half 5 down onto the lower closure half 3.

The invention claimed is:

1. A closure for a container, the closure comprising a lower closure half comprising means to secure the closure to the container, and an upper closure half rotatably mounted on the lower closure half, the closure further comprising an electronic device, and activation means operative to activate the electronic device when the closure is rotated relative to the container, characterized in that the activation means comprises an electronic contact on the lower closure half and another electronic contact on the upper closure half, relative rotation between the closure halves bringing the electronic contacts to ether to complete an electronic circuit to activate the electronic device, one of the electronic contacts comprising a planar contact pad, the other contact comprising a pin which slides over the pad during relative rotation between the closure halves.

2. The closure of claim 1 wherein the upper closure half comprises a cavity for storing the electronic device.

3. The closure of claim 1 wherein rotation limiting means are provided to limit the amount by which one closure half can rotate relative to the other closure half.

4. The closure of claim 3 wherein the rotation limiting means comprises at least one formation on one closure half which, during relative rotation between the closure halves, engages with at least one formation provided on the other closure half.

5. The closure of claim 4 wherein the rotation limiting means comprises a plurality of formations on each closure half.

6. The closure of claim 4 wherein each formation comprises a lug.

7. The closure of claim 6 wherein the lug on the lower closure half is upstanding from the top of the lower closure half.

8. The closure of claim 6 wherein the lug on the upper closure half is radially inwardly directed.

9. The closure of claim 1 wherein the upper closure half is removably mounted on the lower closure half.

10. The closure of claim 9 wherein one of the closure halves comprises securing means that secures the closure halves together.

11. The closure of claim 10 wherein the securing means comprises a peripheral radially projecting rib on one closure half that engages a corresponding peripheral radially projecting rib on the other closure half.

12. The closure of claim 1 wherein the closure comprises a bottle top for screwing onto a bottle.

13. The closure of claim 1 wherein the upper closure half is operative to rotate relative to the lower closure half in the same rotational direction as is required to twist the closure from the container.

14. The closure of claim 1 wherein the electronic device comprises a sound-emitting device.

15. The closure of claim 14 wherein the sound-emitting device comprises a PCB and a speaker operative to emit a pre recorded message when the electronic device is activated.

16. The closure of claim 1 wherein the closure comprises child resistant means.

17. The closure of claim 16 wherein the child resistant means is operative such that the upper closure half has to be pushed down onto the lower closure half to enable rotation of both closure halves to remove the closure from the container.

18. A container provided with a closure comprising a lower closure half comprising means to secure the closure to the container, and an upper closure half rotatably mounted on the lower closure half the closure further comprising an electronic device, and activation means operative to activate the electronic device when the closure is rotated relative to the container, characterized in that the activation means comprises an electronic contact on the lower closure half and another electronic contact on the upper closure half, relative rotation between the closure halves bringing the electronic contacts together to complete an electronic circuit to activate the device, one of the electronic contacts comprising a planar contact pad, the other contact comprising a pin which slides over the pad during relative rotation between the closure halves.

19. A closure for a container, the closure comprising a lower closure half comprising means to secure the closure to the container, and an upper closure half rotatably mounted on the lower closure half an electronic device, and activation means, characterized in that the activation means is operative to activate the electronic device when the closure is pressed down onto the container, the closure halves being so arranged that the upper closure half has to be pushed down onto the lower closure half to enable rotation of both closure halves to remove the closure from the container.

20. The closure of claim 19 wherein the upper closure half comprises a cavity for storing the electronic device.

21. The closure of claim 19 wherein the activation means comprises a switch on one of the closure halves, downward movement of the upper closure half onto the lower closure half moving the switch into a position where the switch completes an electronic circuit which activates the electronic device.

22. The closure of claim 19 wherein the upper and lower closure halves are formed with respective formations operative to lock the two closure halves together when the upper closure half is pressed down onto the lower closure half so that rotation of the upper closure half causes rotation of the lower closure half.

23. The closure of claim 22 wherein the formations comprise castellations.

24. The closure of claim 19 wherein ratchet means is provided operative to permit rotation of one closure half relative to the other closure half in one rotational direction only.

25. The closure of claim 19 wherein the upper closure half is removably mounted on the lower closure half.

26. The closure of claim 25 wherein one of the closure halves comprises securing means that secures the closure halves together.

27. The closure of claim 26 wherein the securing means comprises a peripheral radially projecting rib on one closure half that engages a corresponding peripheral radially projecting rib on the other closure half.

28. The closure of claim 19 wherein the closure comprises a bottle top for screwing onto a bottle.

29. The closure of claim 19 wherein the electronic device comprises a sound-emitting device.

30. The closure of claim 29 wherein the sound-emitting device comprises a PCB and a speaker operative to emit a pre-recorded message when the electronic device is activated.

31. A container provided with a closure comprising a lower closure half comprising means to secure the closure to the container, and an upper closure half rotatably mounted on the lower closure half, an electronic device, and activation means, characterized in that the activation means is operative to activate the electronic device when the closure is pressed down onto the container, the closure halves being so arranged that the upper closure half has to be pushed down onto the lower closure half to enable rotation of both closure halves to remove the closure from the container.

* * * * *